United States Patent [19]

Godley

[11] 3,971,227

[45] July 27, 1976

[54] INSTALLATION OF EXPANDED BASE PILES

[75] Inventor: Augustus P. Godley, Sugar Land, Tex.

[73] Assignee: Raymond International Inc., Houston, Tex.

[22] Filed: Feb. 19, 1974

[21] Appl. No.: 443,222

[52] U.S. Cl. ..... 61/53; 61/53.52; 61/56; 61/56.5; 52/294

[51] Int. Cl.[2] ..... E02D 5/30; E02D 5/48

[58] Field of Search ..... 61/53, 53.52, 53.7, 61/33.74, 56, 56.5; 52/294, 297

[56] References Cited

UNITED STATES PATENTS

| | | | |
|---|---|---|---|
| 1,778,925 | 10/1930 | Thornley | 61/56.5 |
| 2,996,887 | 8/1961 | Rice et al. | 61/53.7 |
| 3,131,543 | 5/1964 | Dougherty | 61/53.7 |
| 3,751,931 | 8/1973 | Merjan | 61/53 |
| 3,779,025 | 12/1973 | Godley et al. | 61/56 |
| 3,875,752 | 4/1975 | Merjan | 61/53 |

FOREIGN PATENTS OR APPLICATIONS

| | | | |
|---|---|---|---|
| 1,211,110 | 2/1966 | Germany | 61/53.6 |
| 783,624 | 9/1957 | United Kingdom | 61/56 |

*Primary Examiner*—Jacob Shapiro
*Attorney, Agent, or Firm*—Fitzpatrick, Cella, Harper & Scinto

[57] ABSTRACT

A massive precast pile tip is provided with a tubular sleeve which extends into the tip to tightly encircle a core of the tip mandrel. The sleeve strengthens the tip material in the core region to improve its driving strength. A mandrel fits into the sleeve and drives the tip. Concrete is then poured into a tubular stem which extends up from the sleeve to the surface of the earth after the tip is driven.

22 Claims, 5 Drawing Figures

INSTALLATION OF EXPANDED BASE PILES

This invention relates to the formation of piles and more particularly it concerns novel method and structures related to enlarged base or so called "bulb" piles.

Enlarged base piles are used for supporting structures built over soils which are incapable of building up substantial side friction forces along the sides of the pile. Such soils are comparatively loose and granular; and in most cases they are capable of withstanding only limited end thrusts. The use of enlarged base piles enables these soils to support large loads by reducing the unit pressure which the pile tip exerts on the soil and further by strengthening the soil through a build-up of a high pressure region in the soil surrounding the pile tip in the earth. This pressure build-up requires application of force to the soil in the region of the pile tip. In some cases this pressure is applied by forcing wet concrete out from the bottom of a predriven casing so that it spreads out as a bulb and displaces the earth at the bearing strata before hardening. Such technique is exemplified in U.S. Pat. No. 3,113,436 to J. L. Nalen and assigned to the Assignee of the present invention. It has also been proposed to provide the necessary force application to the earth at the pile tip by driving an enlarged base, such as a massive precast concrete tip member, down through the earth to the bearing strata. Such technique is discussed in U.S. Pat. No. 3,751,931 to Stanley Merjan.

The present invention provides improvements to the pile installation arrangements of the prior art. More particularly, the present invention permits the construction of enlarged base piles in a rapid and economical manner through the driving of massive precast pile tips followed by the installation of pile stems on top of these tips. Moreover, these pile tips can be driven under greater forces than has heretofore been possible so that a greater pressure build up and greater loading capacity is produced in the earth surrounding the driven tips.

According to one aspect of the present invention there is provided a massive precast pile tip, preferably of concrete. A metal tube of substantially smaller diameter than this tip is cast into it so that the metal tube forms a band tightly enclosing a core of the tip material. The tip is driven into the earth by application of driving or hammering forces to this core. The metal tube, by containing the lateral forces which are developed during hammering, prevents shear failure and thereby permits the tip to be driven under greater force than was heretofore possible.

According to a further aspect of the present invention a metal tube is cast into a precast pile tip as described above; however, the tube extends out from the tip a substantial distance, e.g., two diameters of the tube. As driving forces are applied through the mandrel to the precast tip, the tube maintains the tip in alignment with the mandrel. In addition, a shoulder may be provided on the mandrel at the upper end of the tube so that some portion of the mandrel driving force will be applied to the tip via the tube and this force is transmitted down through the tube to the interior of the tip thereby helping to distribute stresses throughout the tip.

According to a further aspect of the invention the forces applied by a mandrel are evenly applied to the surface of a precast concrete tip by interposing between the mandrel and the tip a layer of dry pack grout, i.e., a grout mixture comprising sand, cement and water in sufficient quantity to cause hydration and curing of the grout only when the mixture is subjected to high pressure. The hammering or driving forces applied from the mandrel through the grout mixture cause the mixture to conform to the concrete surface so as to distribute the driving forces evenly to it and at the same time the grout becomes cured so that it forms an integral part of the concrete tip. Throughout the driving, moreover, the dry pack grout retains the ability to transmit mandrel forces to the concrete tip without loss of driving power.

There has been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis of the designing of other structures for carrying out the purposes of this invention. It is important, therefore, that this disclosure be regarded as including such equivalent constructions as do not depart from the spirit and scope of the invention.

Several embodiments of the invention have been chosen for purposes of illustration and description, and are shown in the accompanying drawings forming a part of the specification, wherein.

Figures 1, 2, 3:
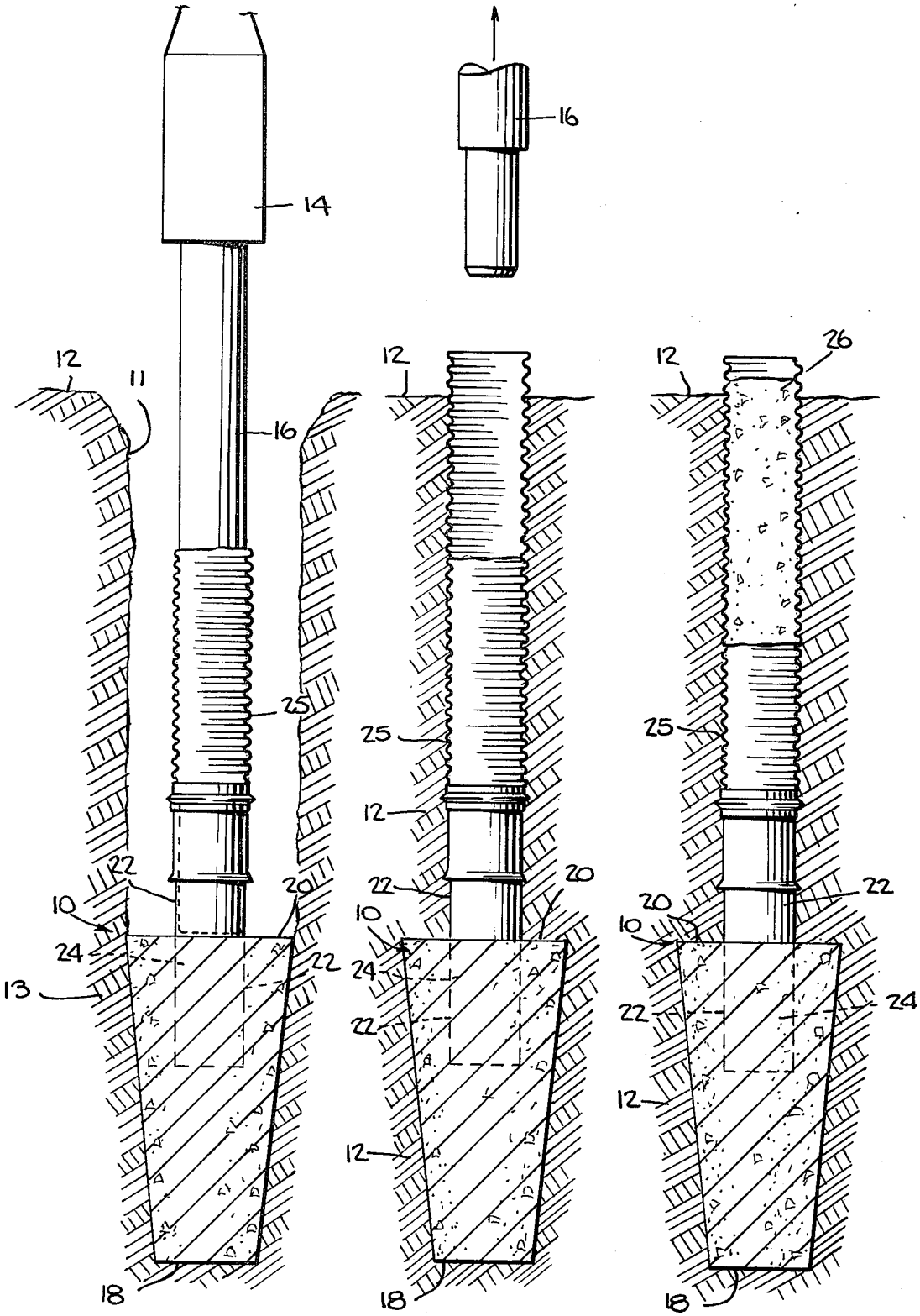
FIG. 1 is an elevational view, partially cut away, showing a first step in the installation of a pile according to the present invention.
FIG. 2 is an elevational view similar to FIG. 1 but showing a second step in the installation of a pile according to the present invention.
FIG. 3 is an elevational view similar to FIGS. 1 and 2 but showing a final step in the installation of a pile according to the present invention.

As shown in FIG. 1, a pile according to the present invention is installed by placing a massive precast pile tip 10 in a predrilled or jetted hole 11 in the ground 12 and then driving it downwardly into a bearing region 13 by means of a hammer 14 which applies its driving forces down through an elongated driving mandrel 16. In some cases the predrilling may be omitted; and the tip then is hammer driven from the surface 12 down to and into the bearing region 13. The pile tip 10 is made of concrete; and it may have reinforcing metal or other material distributed throughout in order to strengthen it against the driving forces. The size of the tip 10 depends, of course, on the nature of the soil into which it is to be driven, the depth to which it is to be driven and the load which is to be supported. By way of example, however, the tip 10, which is in the shape of an inverted truncated cone, may have a flat bottom end 18 whose diameter is about thirty inches. The height of the tip 10 may be about five feet.

A tubular metal sleeve 22 extends into the top end 20 of the tip. This sleeve may be cast into the tip 10 when the tip is formed. The sleeve 22, in the illustrative embodiment, has an outer diameter of 12.75 inches, a wall thickness of 0.375 inches and a length of about 4 feet. 2 feet of the sleeve's length, i.e., about two diameters of the sleeve, extends into the tip 10 from the top end 20 thereof while the remaining two feet of the sleeve, also about two diameters, extends up from the top end 20.

Figure 4:
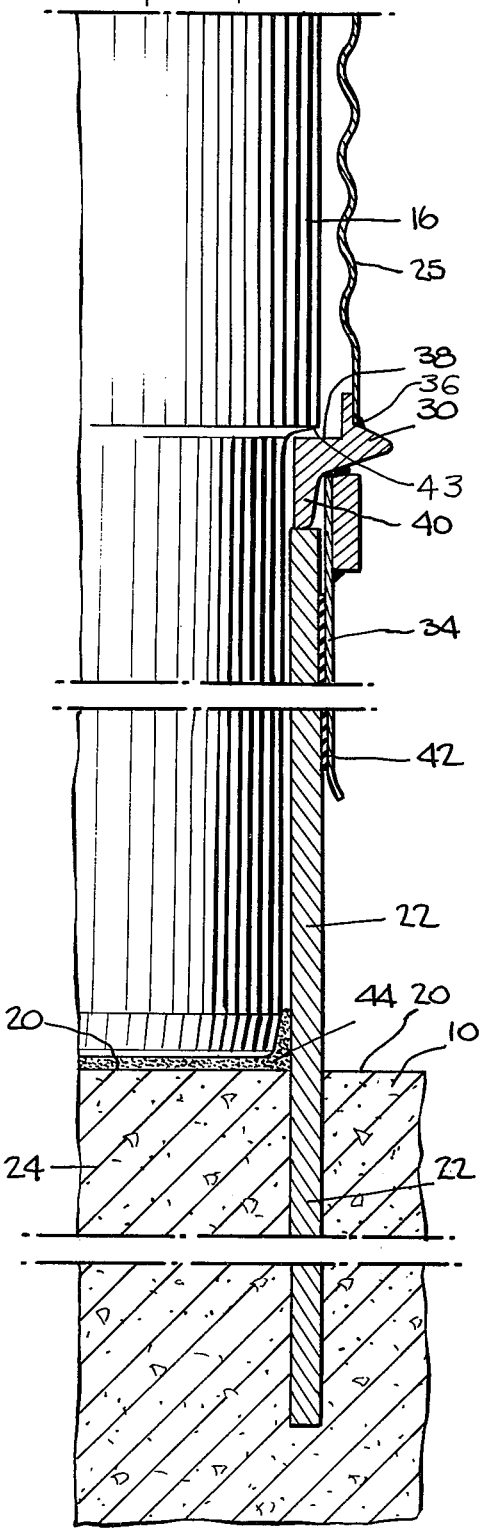
FIG. 4 is an enlarged fragmentary section view taken along line 4—4 of FIG. 1.

As can be seen in FIGS. 1 and 4, the lower half of the sleeve 22 tightly surrounds a central core 24 of the material of the tip 10. The upper half of the sleeve closely but loosely surrounds the lower end of the driving mandrel 16.

A thin walled tubular stem casing 25 of corrugated metal tubing surrounds the mandrel 16 and extends upwardly from the sleeve 22 toward the hammer 14. As shown in FIG. 2, the stem casing 25, whose diameter is close to that of the sleeve 22, is driven into the ground 12 with the tip 10 and the sleeve 22. The length of the stem casing 25 is such that when the pile is driven to its final bearing depth, the upper end of the stem is at or near the ground surface.

After the tip 10 and stem casing 25 are driven to their final bearing depth, the mandrel 16 is withdrawn as shown in FIG. 2. Thereafter the stem casing 25 is filled with concrete to form a pile stem 26 as shown in FIG. 3. It will be noted that although the tip 10 is installed under hammering or driving forces, the pile stem 26 is not subjected to such forces. Thus the stem diameter need be only large enough to transmit static loads down to the tip 10. If the stem concrete had to transmit the driving forces of the hammer 14 its diameter would of course, have to be much larger.

Because the tip 10 is driven to its final depth, and because it is designed to produce substantial displacement to pressurize and strengthen the surrounding earth, the tip must be capable of sustaining very substantial driving forces. The ability of the precast tip 10 to withstand these driving forces is enhanced, according to the present invention, by virtue of the lower half of the sleeve 22 which extends down into the tip 10 and tightly surrounds the central core 24 of the tip.

The driving forces of the mandrel 16 are applied to the upper end of the tip core 24. When the mandrel is driven downwardly, the core 24 is subjected to intense compressive loading forces. Although concrete is characterized by very high compressive loading strength, its tensile and shear strength are not nearly so great. Also because of the nature of the concrete material, hammer blows and similar driving forces produce lateral shear stresses within the tip material. Because the shear strength of concrete is considerably less than its compressive strength, the concrete tends to fail under hammer blows which are well below the ultimate compressive strength of the concrete.

The lower half of the sleeve 22, which tightly surrounds the core 24 of the concrete tip 10, serves to contain the lateral forces which are generated during driving of the tip. By thus reinforcing the lateral deflections of the concrete core 24, the core may be driven under forces more closely approaching its ultimate compressive strength than it could be driven otherwise. The lower half of the sleeve 22 further serves to isolate the exterior or peripheral regions of the tip 10 from the outward lateral forces produced during driving the tip. The outward forces produced during driving of the tip. These outward forces are otherwise manifested as tensile forces in the peripheral regions, and since concrete is generally weakest in tension, the exposure of these regions to such tensile stresses further limits the tolerable driving forces which can be applied to the tip.

Turning now to FIG. 4, it will be seen that the upper end of the sleeve 22 is connected to the lower end of the stem casing 25 through a drive joint comprising a ring collar 30, a band 32 and a skirt 34. The lower end of the stem casing is welded to the outside of the ring collar 30 at 36. The ring collar extends slightly inwardly of the stem casing and is formed with an inner drive ledge 38 and a downwardly extending driving abutment 40. A shoulder 43 on the drive mandrel 16 engages the ledge 38 while the driving abutment 40 rests on the top edge of the sleeve 22.

The skirt 34 is welded to the lower portion of the collar 30 just outside the abutment 40 to extend downwardly therefrom. The band 32 fits around the upper end of the skirt 34 and is welded to both the skirt and the ring collar 30. The skirt 34 fits down over the upper end of the sleeve 22; and a layer of moisture resistant material 42 seals the region between the skirt and sleeve. The above described stem to sleeve interconnection is similar to that shown and described in Catalog S-74 of Raymond International Inc., and it is generally well known in the industry for other applications.

Figure 5:
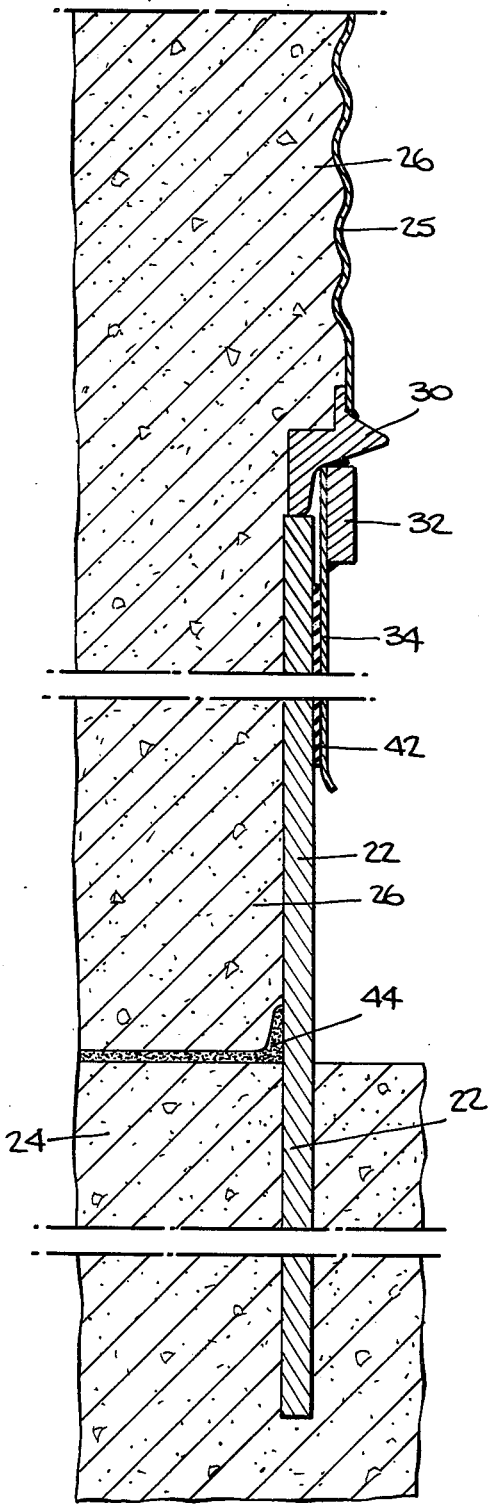
FIG. 5 is an enlarged fragmentary section view taken along line 5—5 of FIG. 3.

It will be noted from FIG. 4 that a layer of packing material 44 is interposed between the bottom of the mandrel 16 and the upper surface of the concrete core 24. This packing material serves to distribute the mandrel forces over the core surface and to compensate for any surface irregularities in that surface. The packing material 24, which is known as "dry pack grout" comprises a mixture of cement and sand with just sufficient water for hydration of the cement only when the cement is subjected to high pressure. Actually, the "dry pack grout" is dry to the touch, even though it does have a finite moisture content. The use of dry pack grout enables the mandrel driving forces to be transmitted efficiently into the tip 10. Also, the driving causes curing of the grout so that when the concrete stem 26 is poured a good transition from the stem to the tip is obtained as shown in FIG. 5.

The distance between the tip of the mandrel 16 and its shoulder 43 is such that some portion of the mandrel driving force is exerted through the ring collar 30 and onto the top of the sleeve 22. The sleeve 22 thus transmits some of the driving energy down into the interior of the tip 10 and thereby assists in the distribution of stresses. The upper portion of the sleeve 22 further serves to stabilize the tip 10 and maintain it properly oriented with respect to the mandrel 16 during driving. In some instances it may be desired to shorten the tip length of the mandrel so that all driving is done on the upper end of the sleeve 22.

Although a particular embodiment of the invention is herein disclosed for purposes of explanation, various modifications thereof, after study of this specification, will be apparent to those skilled in the art to which the invention pertains.

What is claimed and desired to be secured by letters patent is:

1. A foundation pile construction comprising a massive precast pile tip driven into the earth, a tubular sleeve extending part way into the material of said tip, said sleeve extending out from said tip, and an elongated tubular stem casing fixedly attached to said tubular sleeve by a ring having an internal shoulder for receiving hammer blows, said tubular stem casing extending therefrom, up to the surface of the earth and being of substantially thinner wall thickness than that of said sleeve.

2. A foundation pile construction according to claim 1 wherein said tip is of substantially larger cross section than said stem casing.

3. A foundation pile construction according to claim 1 wherein said tip is concrete.

4. A foundation pile construction according to claim 3 wherein said stem casing is filled with concrete.

5. A foundation pile construction according to claim 4 wherein said tip and stem concrete are interconnected with pressure cured dry pack grout.

6. A driveable pile point assembly comprising a massive precast tip element and a metal sleeve having a cross section substantially smaller than that of said tip element, said sleeve extending into the material of said tip element and tightly encasing a core of the tip element whereby driving forces applied to said core are laterally contained by said tube thereby to provide high-driving capability, and a driving mandrel extending down inside said sleeve and contacting said core encased by said sleeve.

7. A driveable pile point assembly according to claim 6 wherein the tip element is concrete.

8. A driveable pile point assembly according to claim 6 wherein the tip element is in the shape of an inverted truncated cone.

9. A driveable pile point assembly according to claim 6 wherein said sleeve extends out from said tip to provide alignment means for maintaining said tip aligned with said driving mandrel.

10. A driveable pile point assembly to claim 6 wherein said sleeve extends into said tip to a distance of about two diameters of said sleeve.

11. A driveable joint assembly according to claim 6 wherein a portion of said sleeve extends outside said tip element and closely but loosely surrounds the lower end of said driving mandrel and thereby forms an alignment sleeve for maintaining said tip in proper orientation when driven by hammer blows applied through said mandrel.

12. A driveable pile point assembly according to claim 11 wherein said sleeve extends up out from said tip element to a distance of about two sleeve diameters.

13. A driveable pile point assembly according to claim 11 wherein the tip is substantially coplanar both inside and outside said sleeve.

14. A combination according to claim 6 wherein said tip element is concrete and wherein a layer of dry pack, pressure cureable, grout is interposed between the mandrel and the concrete of the tip element.

15. A combination according to claim 6 wherein the mandrel is formed with a shoulder positioned for directing a portion of the mandrel driving forces to the top of said sleeve.

16. A method of constructing a pile, said method comprising the steps of forming a massive precast pile tip having a driving surface and a metal sleeve of substantially smaller diameter than said tip cast into the material of said tip and extending inwardly thereof and tightly surrounding a core of the material of said tip, applying hammer blows to said driving surface in a region encircled by said sleeve to drive said tip into the earth, and thereafter forming a stem on top of the driven tip.

17. A method of constructing a pile according to claim 16 wherein a portion of the hammer blow energy is directed to the top edge of the sleeve.

18. A method of constructing a pile according to claim 16 wherein a hole is predrilled in the ground extending down to a bearing surface and said precast pile point is inserted into said hole before applying said hammer.

19. A method of constructing a pile according to claim 16 wherein a tubular stem casing is driven with said tip.

20. A method of constructing a pile according to claim 19. wherein said stem is formed by pouring concrete into said stem casing.

21. A method of driving a precast concrete pile tip comprising the step of placing on a surface of the tip to be driven a layer of dry pack grout comprising a mixture of cement sand and water sufficient to cause hydration and curing only when the mixture is subjected to high pressure and thereafter placing a driving mandrel on the layer of grout and driving the tip by applications of driving forces through the mandrel and the layer of grout to the tip.

22. In combination, a driveable pile point comprising a massive precast tip element and a metal sleeve having a cross section substantially smaller than that of said tip element, an elongated driving mandrel; said sleeve extending from within the material of said tip element and tightly encasing a core of the tip element and forming an alignment sleeve for maintaining said tip in proper orientation when driven by hammer blows applied through said mandrel, the lower end of said mandrel fitting closely but loosely within said alignment sleeve.

* * * * *